United States Patent [19]

Canini

[11] Patent Number: 4,911,329

[45] Date of Patent: Mar. 27, 1990

[54] EXTENDABLE-SPOUT POURING DEVICE FOR CONTAINERS

[76] Inventor: Ferruccio Canini, Via Amarena 4, 16143 Genoa, Italy

[21] Appl. No.: 264,214

[22] Filed: Oct. 28, 1988

[30] Foreign Application Priority Data

Nov. 17, 1987 [IT] Italy ..... 15241/87[U]
Dec. 9, 1987 [IT] Italy ..... 12598 A/87
Jan. 19, 1988 [IT] Italy ..... 12405 A/88

[51] Int. Cl.[4] ..... B67B 7/24

[52] U.S. Cl. ..... 222/81; 222/525; 222/539

[58] Field of Search ..... 222/538, 539, 531, 537, 222/526, 80, 81, 541, 542, 509, 510, 525, 566, 85, 464, 532, 540

[56] References Cited

U.S. PATENT DOCUMENTS 1,140,295 5/1915 Tamagno ..... 222/525
1,908,707 5/1933 Kramer ..... 222/539
2,545,178 3/1981 Vaughn ..... 222/538

*Primary Examiner*—Kevin P. Shaver
*Assistant Examiner*—Kenneth Noland
*Attorney, Agent, or Firm*—Emmanuel J. Lobato; Robert E. Burns

[57] ABSTRACT

This invention concerns a pouring device for containers, with a folding spout, and which envisages inside the container (1) and tube (2) fitted with removable or breakable seals (4, 5) on both ends, containing an axially mobile plug (6) which has a holded sleeve (7) and a pouring spout (8) on its upper end, while the wall of the container (1) has a weakened breaking area (11) in the position corresponding to the axis of the spout (8), so that a manual or mechanical thrust of the plug (6) forces out the spout (8) and allows the contents to be poured, flowing out through the holes of the holded sleeve (7) (FIG. 1).

13 Claims, 3 Drawing Sheets

EXTENDABLE-SPOUT POURING DEVICE FOR CONTAINERS

BACKGROUND OF THE INVENTION

Various types of product containers are known made of metal, plastic, glass and so on which are closed and sealed in various ways after filling.

For example containers which can be opened by pulling a tab along a weakened line are known, and also containers having closing and sealing plugs with removable parts to open the pouring-hole. Also containers which are opened by cutting or separating glued lips are known.

Plugs with pouring spouts are also known, but these usually require additional upper closing and sealing plugs which have to be removed before pouring.

All these known solutions have some drawbacks, and mainly these consist of difficulties in opening them and pouring, lack of hygiene or protruding parts which make it difficult to stack the containers in piles for storage, and also the seals are not sufficiently safe to protect the contents from being tampered with.

BRIEF SUMMARY OF THE INVENTION

The purpose of this invention is to eliminate or reduce said drawbacks, that is to say, to propose a device with an extendable spout capable of making opening and pouring easy, capable of guaranteeing maximum hygiene, capable of eliminating any protuberances beyond the overall dimensions of the container, and capable of guaranteeing proper sealing and safeguarding of the contents.

Basically, the invention entails fitting inside a container, and securing at least to its bottom, a tube with an axially mobile plug inside it equipped with a holed sleeve on top which ends in a tubular spout. When the container is full and sealed, the plug with its sleeve and spout remain inside the tube, while for pouring purposes, the plug is pushed upwards so that the spout protrudes out of the lid of the container and the holed sleeve is positioned between the upper end of the tube and the lid, allowing the flow of the contents to the delivery spout.

Obviously the tube is sealed on its ends and at least on the upper end with removable parts, and also the area of the lid in line with the spout is partly thinner, so that it can be easily holed by the spout itself.

Another purpose of this invention is to allow cooling of the material inside the container by means of a cooling cartridge, to be introduced into said tube, behind the plug, which in this case will be shorter. In practice, the plug will be limited to its upper part consisting of the sleeve and the spout.

DETAILED DESCRIPTION OF A PREFERRED EMBODIMENT

Figure 1:
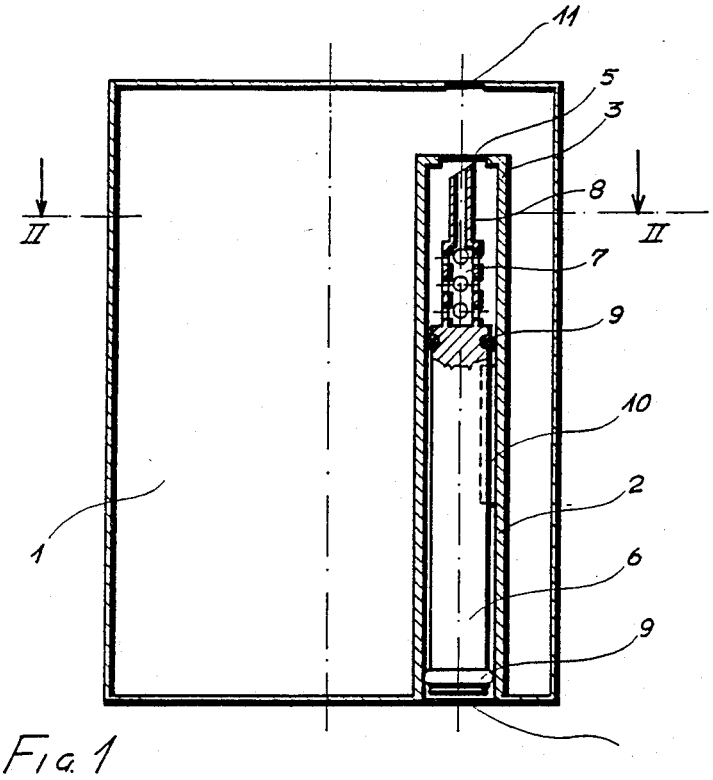
FIG. 1 shows a central vertical cross-section of a container fitted with the device covered by the invention, in a retracted position.
Figure 2:
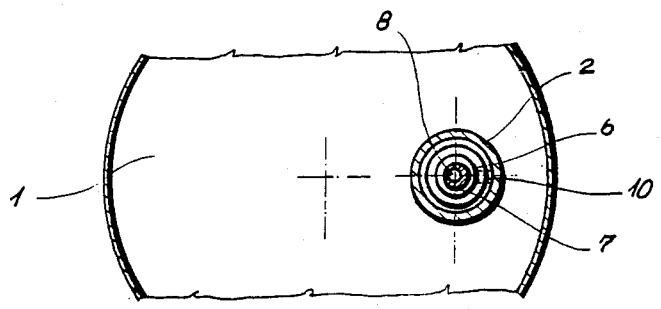
FIG. 2 shows a cross-section on X—X of the same container illustrated in FIG. 1.

With reference to said figures, the container (1) has inside it a tube (2) secured to its bottom and with on the top end an internal step (3). The bottom, in a position corresponding to the tube, and the tube, at the height of the step 3, have areas (4,5) which are removable or can be broken along a weakended line or due to the extra thinness of the wall. Said tube (2) may formed as a part of the container or may be fitted into it. Naturally it is possible to eliminate the lower seal of the tube (2), since sealing is ensured by gaskets and by the upper seal. Inside the tube (2) there is an axially mobile plug (6) which has at the top a part shaped into a holed sleeve (7) which in turn ends in a tubular spout (8). Altogether, the plug-sleeve-spout unit is slightly lower than the height of the tube (2), so that it can be housed inside the latter. Suitable gaskets (9) ensure sealing between the plug (6) and the tube (2), while a raised part (10) inside the tube (2) fits into a corresponding groove in the plug (6) to prevent rotation of the plug and spout, so that the lip of the spout, generally cut on a slant, remains in the best position for pouring out the contents.

Figure 3:
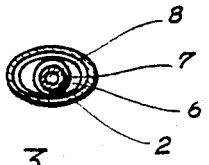
FIG. 3 is a cross-section of the device with the tube and plug having an elliptical cross-section to prevent rotation.

In order to prevent rotation of the plug (6) and of the spout (8) it is also possible to give the tube (2) and the plug (6) an elliptical cross-section as shown in FIG. 3, doing away with the raised part 10. On the same axis as the spout (8), there is a weakened area (11) on the lid, which is easily broken through by perforating it.

Figure 4:
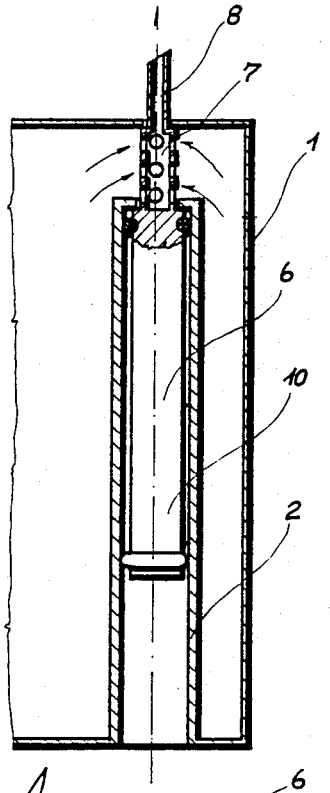
FIG. 4 shows the container of FIG. 1 with the spout in the extended position, ready for pouring.

FIG. 4 shows the container in a pouring phase. For practical reasons the container is shown with the spout pointing upwards while in actual fact it would be tilted or facing downwards. In FIG. 4 the plug is pushed upwards from the bottom after breaking the seal, if any, and with this movement the sleeve (8) breaks the seal (5) of the tube (2) and the seal (11) in the lid, and protrudes outwards. The holed sleeve (7) is located between the tube (2) and the lid, to allow bubbling of the contents through its holes and its outflow through the spout (8). As can be seen, in the extended position, the plug (6) rests against the step (3) of the tube (2) and the holed sleeve (7) rests against the inside of the lid, ensuring sealing, which may also be improved by suitable gaskets, not shown in the drawing.

Figure 6:
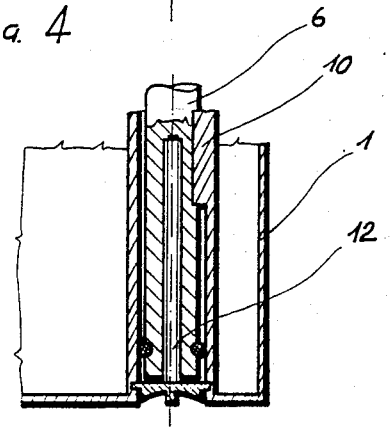
FIG. 6 shows a variant with screw-type movement of the plug bearing the spout.

In the example illustrated in FIGS. 1 to 4, the plug (6) is pushed upwards by hand (generally with one finger), but the plug may also be moved mechanically, for example by means of a screw (12), as shown in FIG. 6. This screw (12) solution makes it easier to withdraw the spout into the container in the event of intermittent pouring and, in case of intermittent pouring as stated, the upper weakened area (11) of the lid will preferably have elastic lips which can close when the pouring spout is retracted. Also in the solution in FIG. 6, the screw is operated by means of a rotating knob which replaces the seal 4.

Figure 5:
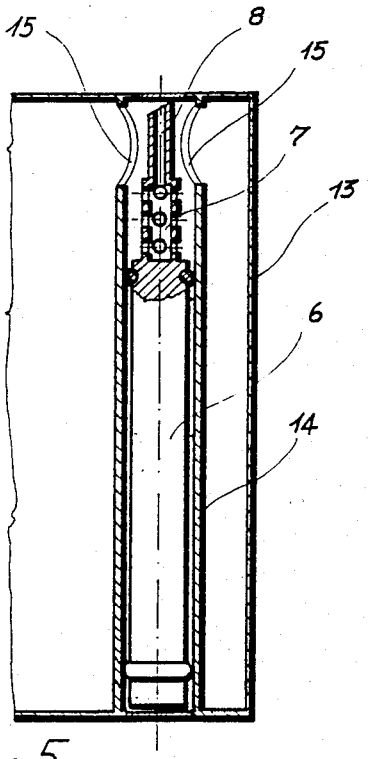
FIG. 5 shows a container with the tube connected to the bottom and to the lid.

In the case of non-rigid and deformable containers (13), the tube (14) covers the whole length between the bottom and the lid, and at the top has wide openings (15) for the passage of the contents, as shown in FIG. 5. In FIG. 5 the pouring spout is shown just below the weakened area of the lid, but it is also possible to adopt a solution identical to that shown in FIG. 1, but with the tube connected to the lid and closed under the opening (15) by the breakable seal (5).

Figure 7:
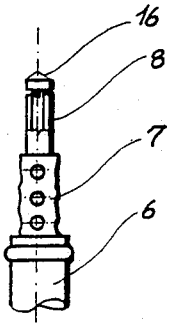
FIG. 7 shows yet another variant in which the spout is fitted with a screw-on cap.
Figure 8:
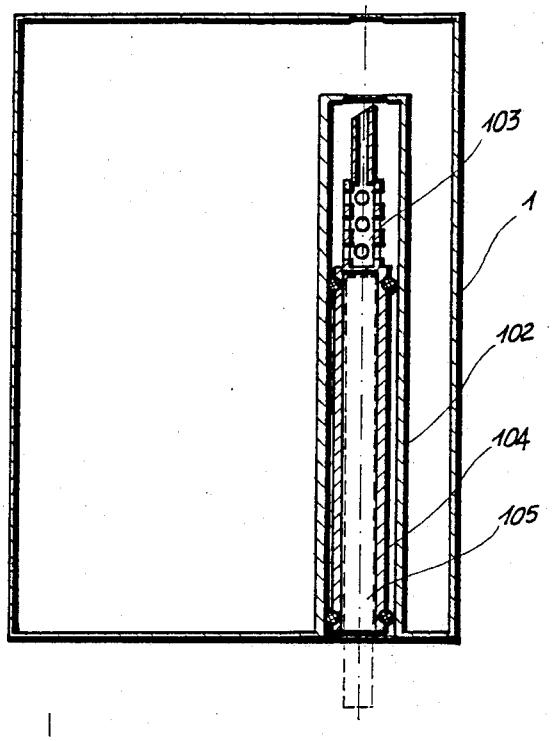
FIG. 8 shows a container with a cooling cartridge placed inside the extendable pouring device.

In FIG. 7, a spout (8), possibly fitted with a screw-on cap (16) is shown by way of example. Naturally for specific types of packaging, the pouring device mentioned and including the tube (2), the plug (6), the holed sleeve (7) and the spout (8) may be arranged in a horizontal or slanting position. It is also possible to provide a solution in which these elements have a circular arrangement. Naturally the tube (2) secured to the bottom and/or to the lid may also be secured in a different way, for example to the walls. With the solution in which the movement of the plug (2) is caused by a screw (12), the plug may be considerably shorter, and may even be used only as a short base for the sleeve (7) and the spout (8). With reference to FIG. 8, (1) is the container, with inside it the blind tube (102), and inside which is the extendable pouring device (103). This pouring device (103) has a lower plug (104), which in the case in point is hollow, and can be used to contain a cooling cartridge (105), which may end at the bottom of the container or may extend beyond the bottom (as shown in FIGS. 8 and 9), to facilitate the pushing upwards of the device.

Figure 9:
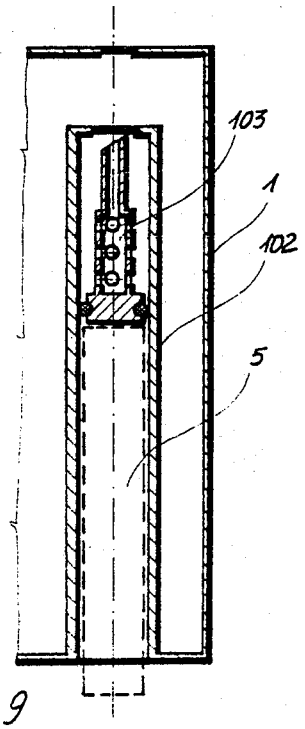
FIG. 9 shows a container with a cooling cartridge placed in the tube of the extendable pouring device and acting as its thrusting organ.

In FIG. 9, the extendable pouring device (103) has no lower plug, and therefore the cooling cartridge (105) is inserted directly into the blind tube (102), until it rests against the pouring device. With this solution, the cooling cartridge (105) must protrude from the bottom of the container (1), so as to allow and facilitate pushing upwards of the pouring device (103).

Figure 10:
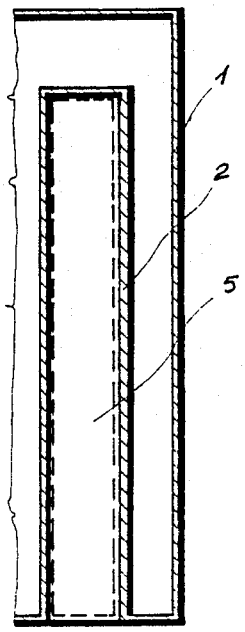
FIG. 10 shows a container with a cooling cartridge placed in a blind tube.

In FIG. 10 there is only a blind tube (102), with no extendable pouring device, and therefore the cooling cartridge (105) is contained simply inside the blind tube.

Of course the blind tube (102) and the relevant cooling cartridge (105) may have any shape, and may be positioned anywhere inside the container (1), for example vertically, horizontally, slanting and so on. In addition, they may be equipped with suitable organs for retaining the cooling cartridge inside the tube or inside the body of the pouring device. The drink container and the cooling cartridge are normally stored in a normal refrigerator and in a low-temperature freezer respectively, and depending on requirements, the cartridge is fitted into the container some time before consumption, so that the drink may be drunk at the desired temperature.

What I claim is:

1. A container for containing flowable contents and having a spout arrangement housed therein comprising, a tube entirely housed internally of the container having an end facing an internal surface of an outer wall of the container at which contents are to be discharged and having an opposite open end secured fluid-tight to an inner surface of an opposite outer wall of the container, a plug axially displaceable between a retracted position in the tube and an operating position for effecting discharge of contents from the container, the plug having a sleeve axial extension open at a free and thereof defining a spout through which contents are discharged, the sleeve having an axial length such that when the plug is in the retracted position in the tube the sleeve is entirely housed in the container, said sleeve having circumferential, axially spaced through openings disposed spaced from said open end thereof and a remaining open end portion defining the spout being solid circumferentially, said container having an opening in registry with said tube to allow the plug to be displaced axially toward the outer wall at which discharge of contents is effected, means for effecting a seal between the plug and the tube to maintain complete absence of communication between the interior of the container and the interior of the tube while allowing displacement of the plug axially of the tube, said container having an area penetrable by the spout open end of the sleeve when the plug is displaced to the operating position for projecting the spout outwardly of the container for effecting discharge of contents, and the through openings providing communication between the interior of the container and the interior of the sleeve and the spout thereof when the spout is projected outwardly of the container.

2. A container for containing flowable contents and having a spout arrangement housed therein according to claim 1, in which said plug has means thereon for precluding rotation thereof in a circumferential direction within the tube.

3. A container for containing flowable contents and having a spout arrangement housed therein according to claim 1, in which said tube and said spout have complementary elliptical cross sections to preclude rotation of the plug in a circumferential direction within the tube.

4. A container for containing flowable contents and having a spout arrangement housed therein according to claim 1, in which said tube having said end facing said internal surface on an outer wall of the container at which discharge is effected fixed fluid tight to said inner surface, and said tube having openings adjacent said inner surface providing communication into the interior of the container to allow contents to pass into said spout.

5. A container for containing flowable contents and having a spout arrangement housed therein according to claim 1, further including screw means connected to the plug for displacing the plug axially of the tube between the retracted and operating position thereof.

6. A container for containing flowable contents and having a spout arrangement housed therein according to claim 1, in which said tube is disposed vertically when the container is in a normal not in use position thereof.

7. A container for containing flowable contents and having a spout arrangement housed therein according to claim 1, in which said tube is disposed in a slanted position displaced from the vertical when the container is in a normal not in use position thereof.

8. A container for containing flowable contents and having a spout arrangement housed therein according to claim 1, in which said spout has a sealing cap on the open free end thereof.

9. A container for containing flowable contents and having a spout arrangement housed therein according to claim 1, in which said plug comprises a cooling cartridge for cooling said contents.

10. A container for containing flowable contents and having a spout arrangement housed therein according to claim 1, in which said plug is a cooling cartridge for cooling said contents.

11. A container for containing flowable contents and having a spout arrangement housed therein according to claim 1, in which said open end of the tube has a breakable seal closing the open end.

12. A container for containing flowable contents and having a spout arrangement housed therein according to claim 1, in which said tube is open ended, and breakable seals closing the ends of the tube.

13. A container for containing flowable contents and having a spout arrangement housed therein according to claim 1, further including a cooling cartridge maintained in a refrigerated condition and insertable through said open end of the tube for cooling the contents prior to consumption thereof.

* * * * *